United States Patent [19]

Frieden et al.

[11] 3,984,066

[45] Oct. 5, 1976

[54] APPARATUS FOR UNWINDING WIRE FROM REELS

[75] Inventors: Pierre Frieden; Pierre Barisaux, both of Paris, France

[73] Assignee: Thomson-Brandt, Paris, France

[22] Filed: Mar. 19, 1975

[21] Appl. No.: 559,817

[30] Foreign Application Priority Data

Mar. 22, 1974 France ..... 74.09849

[52] U.S. Cl. ..... 242/129

[51] Int. Cl.[2] ..... B65H 49/00

[58] Field of Search ..... 242/128, 129, 129.6, 242/129.62, 137.1, 157 R

[56] References Cited

UNITED STATES PATENTS

| | | | |
|---|---|---|---|
| 1,466,910 | 9/1923 | Lenzi et al. | 242/137.1 |
| 3,321,151 | 5/1967 | Maquire | 242/128 |

FOREIGN PATENTS OR APPLICATIONS

| | | | |
|---|---|---|---|
| 1,008,321 | 10/1965 | United Kingdom | 242/128 |

*Primary Examiner*—Leonard D. Christian
*Attorney, Agent, or Firm*—Edwin E. Greigg

[57] ABSTRACT

An apparatus for continuous unwinding of wire from reels includes two adjacent hollow, partially cylindrical and partially frusto-conical housings, each of which contains a reel of wire. In operation, the tail end of the wire of the first reel is joined to the beginning of the wire on the second reel, permitting continuous unwinding. When one reel is empty, the wire must pass from one hollow housing to the second hollow housing. The apparatus is constructed from two cooperating halves, which may be hinged or capable of other relative motion, to permit passage of the wire when desired but which close fully during the unwinding process to prevent discontinuities in the interior surface which would tend to damage the moving wire.

13 Claims, 6 Drawing Figures

APPARATUS FOR UNWINDING WIRE FROM REELS

BACKGROUND OF THE INVENTION

The invention relates to an apparatus for unwinding wire, especially metallic wire, from stationary reels. One known apparatus for unwinding wire from stationary reels usually includes two tubular elements, partially cylindrical and partially frusto-conical, each of which has a longitudinal slot. The two elements are joined in their conical regions along the edges of their respective longitudinal slots. A reel of wire is placed centrally in each of two cylindrical regions of this unwinding apparatus. The end of the wire on the outer layer of wire of one of the reels is pulled out through an opening at the tip of the frusto-conical portion of the apparatus and the other end of the wire of the same level is soldered to the end of the wire on the outer layer of wire of the second reel. The longitudinal slot of the cylindro-frusto-conical elements permits the wire to pass from one reel to the other.

When the wire is being unwound at great speed, it is propelled against the interior wall of the apparatus. Each point in the wire passes the longitudinal slots at least once and has a tendency to penetrate therein since the shielding and guiding surface provided by the tubular elements has a discontinuity at this location. The repeated encounters between the wire and the edges of the longitudinal slots resemble a repetitive hammering and result in a more or less serious deterioration of the characteristics of the wire, especially of its flexibility.

OBJECT AND SUMMARY OF THE INVENTION

It is a principal object of the invention to provide an improved apparatus for unwinding wire from stationary reels unencumbered by the above described disadvantages.

This object is attained according to the invention by providing an apparatus which has the shape of two cylindro-frusto-conical parts, which are joined in the frusto-conical regions, each cylindrical region being adapted to hold a stationary reel of wire. The improvement according to the invention comprises an apparatus made from two half-shells, at least one of which is movable. The two half shells, when joined and closed, form an assembly of two cylindro-frusto-conical hollow elements whose separation plane passes through their long axes. These two half shells are closed during the unwinding of wire and they are opened while the wire passes from the empty reel to the full reel, located in the adjacent element.

The invention will be better understood as well as other objects and advantages thereof will become more apparent from the ensuing detailed description of three exemplary embodiments taken in conjunction with the drawing.

DESCRIPTION OF THE PREFERRED EMBODIMENTS

Figure 1:
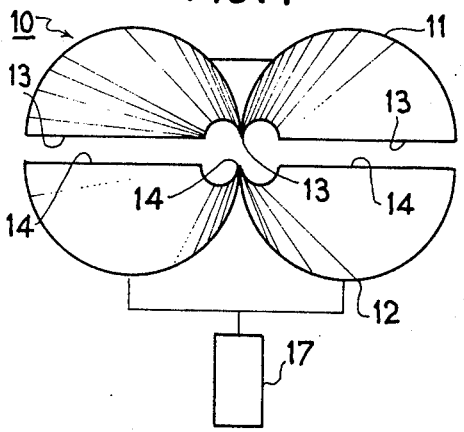
FIG. 1 is a partial schematic, transversely sectional view of a first exemplary embodiment of the apparatus according to the invention.
Figure 2:
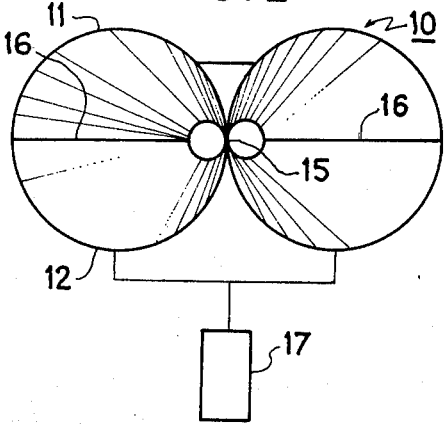
FIG. 2 is a further transverse view of the apparatus of FIG. 1, in closed position.

Turning now to the drawing FIGS. 1-6 illustrate three exemplary embodiments of an apparatus according to the invention for unwinding wire. One of these embodiments (FIGS. 5 and 6), has an exterior shape which is substantially identical to the known apparatus revealed in the Patent to Maguire No. 3,321,151, which, such as illustrated in FIGS. 1 and 2, i.e., has twin cylindro-frusto-conical hollow parts. However, even here, the structure of the apparatus according to the invention is different from the rigid structure of the known apparatus for unwinding wire, such as described above.

According to an important characteristic feature of the invention, the wire unwinding apparatus has a changeable structure, i.e., the apparatus is formed from elements which can undergo relative movements at desired times.

In a first exemplary embodiment of the invention (FIGS. 1 and 2) the wire unwinding apparatus 10 comprises two rigid halves or half-shells 11 and 12, together constituting an assembly of two hollow, twin cylindro-frusto-conical elements and the entire assembly is divided along a median plane which passes through the long axes of the two elements. Only the frusto-conical zones of these two parts are shown. The cooperating edges 13 and 14 of the two half-shells 11 and 12 provide the three joints of the apparatus 10, namely a central joint 15 and two lateral joints 16 and these joints are provided with complementary tongues and grooves which inhibit any relative lateral slipping of these shells after they are closed. A reel of wire is placed centrally in each of the two cylindrical regions of the apparatus 10, in stationary manner. One end of the wire of one reel is connected, for example by soldering, to one end of the wire of the second reel. The portion of wire which connects the two reels passes in the space between the central edges 13 and 14 of the two half-shells 11 and 12, particularly in the cylindrical regions and it is trapped in the joint 15 when the shells are closed. In order to prevent breaking this length of wire, the central edges 13 and 14 are advantageously provided with a resilient covering in the cylindrical region of apparatus 10. When the wire is being unwound, the two half-shells 11 and 12 are closed (FIG. 2). The joints 15 and 16 are hermetic closures so that there is no discontinuity whatever in the interior wall of the apparatus 10 and the wire is not subjected to any hammering or shock encounters, such as occur in the known wire unwinding apparatus. When the unwinding of wire from one reel is complete, the two half-shells 11 and 12 are opened (FIG. 1) and permit the unobstructed passage of the wire from the empty reel to the second, full reel. Once the wire has passed, the half-shells 11 and 12 are closed again so that the discontinuity in the interior wall of the apparatus 10 again disappears completely. The opening and closure of the two half-shells 11 and 12 may be effected by means of a system of two jacks or a system of levers, wherein these jacks or levers are attached to the two half-shells, which, in that case, may both be movable or else a system including a single jack 17 is mounted on one of the two half-shells 12, whereas the other half-shell 11 remains stationary (FIG. 1).

Figure 4:
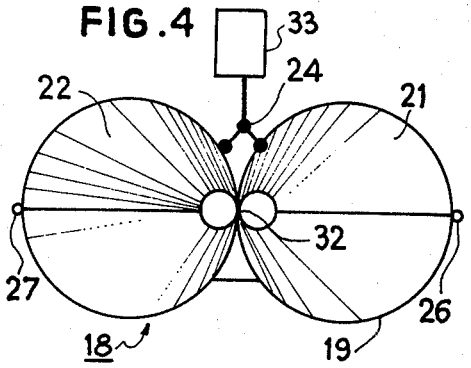
FIG. 4 is a further transverse view of the apparatus of FIG. 3, in closed position.
Figure 5:
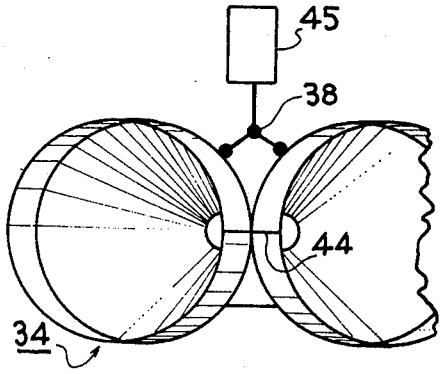
FIG. 5 is a schematic transverse view of a third exemplary embodiment of the invention.

A second exemplary embodiment of the invention is shown in FIG. 5 and 4, where the wire unreeling apparatus 18 comprises two halves 19, 20, which combine to form an assembly of two hollow, twin cylindro-frusto-conical elements which can be separated along a median plane passing through the axis of the two elements; only the frusto-conical zones of these parts have been shown in the figures. The half-shell 19 is a single piece, whereas the half 20 is formed by two members 21, 22 each of which has a semi-cylindrical, frusto-conical shape and whose central regions may be moved by an actuating system. The two lateral, cooperating edges of the two halves 19 and 20 are coupled by hinges 26 and 27. The central cooperating edges 28, 29, 30 and 31 are provided with an elastic covering so as to prevent any cutting of the portion of wire which connects the two reels mounted in the apparatus 18. This portion of wire is jammed in the central, composite joint 32 while the two halves 19 and 20 are closed (FIG. 4). Since the central composite joint 32 and the lateral joints formed by the edges 26 and 27 are all hermetic seals, there is no discontinuity whatever in the inside wall of apparatus 18, so that the wire is not subjected to hammering or shock encounters with the wall during unwinding such as occur in known unwinding apparatus.

Figure 3:
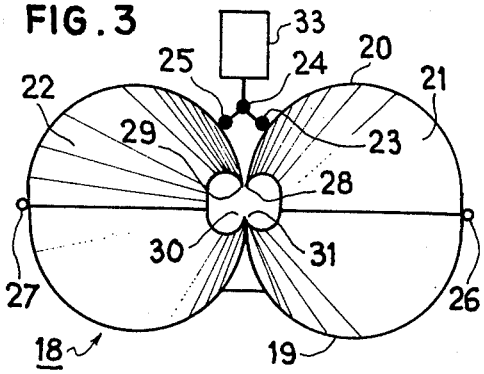
FIG. 3 is a partial schematic transverse view of a second exemplary embodiment of the invention.

When one reel is completely unwound, the half-shell 20, formed by the elements 21 and 22, moves away from the half-shell 19 by pivoting about the hinges 26 and 27 under the control of the system 23, 24, 25. Thus, the central composite joint 32 opens up and permits the unobstructed passage of the wire from the empty reel to the second, full reel. Once the wire has passed over, the two halves 19 and 20 reclose, so that any discontinuity in the interior wall of the apparatus 18 disappears. The opening and closing of the two halves 19 and 20 may be effected by a system of two jacks or a system of levers, where these jacks or levers are attached on the two halves of the apparatus which, in that case, are both movable. Alternatively, the opening and closure may be effected by a system comprising only a single jack 33, connected to a moving system 23, 24, 25 for the half 20, whereas the half 19 remains stationary (FIGS. 3 and 4).

Figure 6:
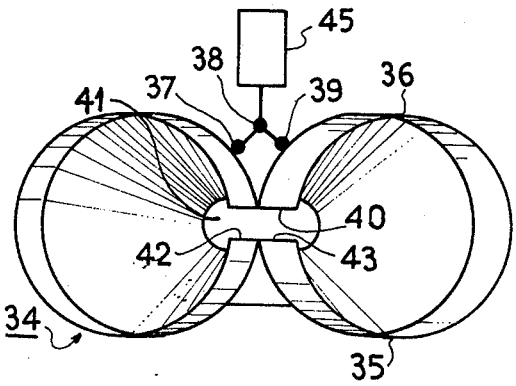
FIG. 6 is a further, transverse view of the apparatus of FIG. 8, in the open position.

In a third, preferred exemplary embodiment of the invention (FIGS. 5 and 6), the wire unwinding apparatus 34 is analogous to that of the halves 19 and 20 of the second exemplary embodiment which has hinges 26 and 27, but, in this case, there are no joints or hinges. Instead, the half 36 is connected in its central region to an actuating system 37, 38, 39. The cooperating central edges 40, 41, 42, 43 of the two halves 35, 36 form a central composite joint 44 (FIG. 5). In the cylindrical regions of the apparatus, the central edges are provided with an elastic covering so as to prevent cutting or separation of the length of wire which connects the two reels mounted in the apparatus 34. This length of wire is jammed in the central joint 44 while the two halves 35 and 36 are closed during the unwinding of a wire (FIG. 5). The central joint 44 is a hermetic joint; thus there is no discontinuity in the interior wall surface of the apparatus 34, and the wire is not subjected to hammering or shock encounters with the wall during its passage from the apparatus, such as would occur in known unwinding apparatus. When one reel is completely unwound, the half 36 moves away from the half 35. This movement is possible due to the inherent elasticity of the material of which the apparatus 34 is made due to the pivoting effort of the actuating system 37, 38, 39. Thus, the central composite joint 44 opens up and permits the free passage of the wire from the empty reel to the second, full reel. Thereafter, the two halves 35 and 36 close again so that any discontinuity along the interior wall of the apparatus 34 disappears. As before, the opening and closing of the two halves 35 and 36 may be effected by a system of two jacks or levers mounted on the two movable halves, or it may be effected by a system with a single jack, connected at a point 38 to an actuating system 37, 38, 39 for the half 36, whereas the half 35 remains stationary (FIG. 5 and 6).

The jacks 17, 33 and 45 used in the three exemplary embodiments described above may be of the pneumatic, hydraulic or electric type. These jacks may be controlled manually or automatically at appropriate times for opening the two halves of the apparatus so as to permit passage of the wire from the empty reel to the full reel and for re-closing the two halves after the wire has passed over. The wire unwinding apparatus according to the invention may be constructed of metal or of synthetic plastic material.

What is claimed is:

1. In an apparatus for unwinding wire from reels, having the exterior form of two adjacent, hollow, partly cylindrical and partly frusto-conical elements, united along their conical surfaces, each of the cylindrical portions thereof adapted to receive a reel, the improvement comprising:

two cooperating half sections, means associated with said half sections serving to move said half sections in unison toward and away from other half sections lying adjacent thereto, said half sections when joined arranged to form an apparatus having said exterior form and wherein the plane of their junction contains the longitudinal axes of said adjacent, hollow, partly cylindrical and partly frusto-conical elements.

2. An improved apparatus as defined in claim 1, wherein each of said cooperating half sections include a single rigid unit.

3. An improved apparatus as defined in claim 1, wherein said cooperating half sections are made of metal.

4. An improved apparatus as defined in claim 1, wherein said cooperating halves are made of plastic material.

5. An apparatus as defined in claim 1, wherein the said cooperating half sections are provided with complementary edge means for defining and maintaining the relative position of said cooperating half sections.

6. An apparatus as defined in claim 5, wherein said complementary edge means are provided with an elastic covering material.

7. An improved apparatus as defined in claim 1, wherein one of said cooperating half sections is formed by two separate, distinct units which are joined by actuating means.

8. An apparatus as defined in claim 7, wherein at least one edge of each of said two separate, distinct units is provided with a hinge, coupling it to the other of said cooperating half sections.

9. An apparatus as defined in claim 8, wherein the said cooperating half sections are provided with complementary edge means for defining and maintaining the relative position of said cooperating half sections.

10. An apparatus as defined in claim 9, wherein said complementary edge means are provided with an elastic covering material.

11. In an apparatus for unwinding wire from reels, having the exterior form of two adjacent, hollow, partly cylindrical and partly frusto-conical elements, united along their conical surfaces, each of the cylindrical portions thereof adapted to receive a reel, the improvement comprising:

a single deformable unit having said exterior form when undeformed;

and actuating means, attached to a portion of said single, deformable unit, deforming the same to create an internal communication between said elements.

12. An apparatus as defined in claim 1, wherein said means associated with said half sections and arranged to move the same comprises a lever system.

13. An apparatus as defined in claim 12, including a jack means for operating said lever system.

* * * * *